US009148713B2

(12) United States Patent
Miyamoto et al.

(10) Patent No.: US 9,148,713 B2
(45) Date of Patent: Sep. 29, 2015

(54) TELEVISION AND ELECTRONIC DEVICE

(75) Inventors: Tomofumi Miyamoto, Hamura (JP); Hideki Watanabe, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 489 days.

(21) Appl. No.: 13/489,648

(22) Filed: Jun. 6, 2012

(65) Prior Publication Data

US 2013/0058513 A1 Mar. 7, 2013

(30) Foreign Application Priority Data

Sep. 1, 2011 (JP) ..... 2011-190568

(51) Int. Cl.
*H04R 1/02* (2006.01)
*H04R 5/02* (2006.01)

(52) U.S. Cl.
CPC . *H04R 1/02* (2013.01); *H04R 1/025* (2013.01)

(58) Field of Classification Search
CPC ..... H04R 5/02; H04R 1/02; H04R 2499/15; H04R 1/025
USPC ..... 381/333, 388, 349, 306
See application file for complete search history.

(56) References Cited

U.S. PATENT DOCUMENTS

| | | | | |
|---|---|---|---|---|
| 7,106,878 | B2 | 9/2006 | Saiki et al. | |
| 7,565,949 | B2 | 7/2009 | Tojo | |
| 2004/0240689 | A1 | 12/2004 | Miyamoto | |
| 2005/0129263 | A1* | 6/2005 | Tamura et al. | 381/333 |
| 2011/0255727 | A1* | 10/2011 | Azuchi | 381/333 |

FOREIGN PATENT DOCUMENTS

| | | | |
|---|---|---|---|
| JP | 03-115489 | U | 11/1991 |
| JP | 05-191758 | | 7/1993 |
| JP | 05-328470 | A | 12/1993 |
| JP | 08-336195 | | 12/1996 |
| JP | 2000-350121 | A | 12/2000 |
| JP | 2003-280766 | | 10/2003 |
| JP | 2003-111194 | A | 11/2003 |
| JP | 2004-343548 | A | 12/2004 |
| JP | 2004-357220 | | 12/2004 |
| JP | 2006-115272 | A | 4/2006 |
| JP | 2009-189050 | A | 8/2009 |

OTHER PUBLICATIONS

Japanese Office Action for Patent Application No. 2011-190568, dated Aug. 28, 2012, 6 pages including translation.
Japanese Office Action for Patent Application No. 2012-268310, dated Sep. 10, 2013, 7 pages including translation.

* cited by examiner

*Primary Examiner* — Vivian Chin
*Assistant Examiner* — Ammar Hamid
(74) *Attorney, Agent, or Firm* — Knobbe, Martens, Olson & Bear LLP

(57) ABSTRACT

According to at least one embodiment, a television includes a housing further including a pair of corner portions and an enclosed space on an inner side thereof, a pair of speaker boxes housed in the enclosed space in vicinities of the corner portions, a pair of speakers housed in the speaker boxes respectively in a direction which crosses a thickness direction of the housing, and each of the speaker boxes further includes a first duct to guide sounds from a first side of the respective speaker to the respective first opening portion and a second duct to guide sounds from a second side of the respective speaker towards the enclosed space.

9 Claims, 14 Drawing Sheets

TELEVISION AND ELECTRONIC DEVICE

CROSS-REFERENCE TO RELATED APPLICATIONS

This application is based upon and claims the benefit of priority from prior Japanese Patent Application No. 2011-190568, filed Sep. 1, 2011, the entire contents of which are incorporated herein by reference.

FIELD

Embodiments described herein relate generally to a television or an electronic device comprising a speaker.

BACKGROUND

There are conventionally electronic devices, for example, notebook type portable computers, which comprise speaker units at right and left sides thereof.

For such electronic devices, the sound quality can be a factor which determines the competitive strength of the device in the market, and therefore there is always the need for improving the sound quality and the improvement of the quality of the sound output from the device is required.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a television includes a housing further including a pair of corner portions and an enclosed space on an inner side thereof, a pair of speaker boxes housed in the enclosed space in vicinities of the corner portions, a pair of speakers housed in the speaker boxes respectively in a direction which crosses a thickness direction of the housing, and the housing further includes a pair of first opening portion provided in vicinities of the speaker boxes and a second opening portion located between the pair of first opening portion and communicated to the enclosed space, and each of the speaker boxes further includes a first duct to guide sounds from a first side of the respective speaker to the respective first opening portion and a second duct to guide sounds from a second side of the respective speaker towards the enclosed space.

An embodiment of a television which is an example of an electronic device will now be described with reference to FIGS. 1 and 2. In the first embodiment, the near side (that is, the user side) is defined as the front direction F, the far side as viewed from the user is the rear direction B, the left-hand side as viewed from the user is the left direction L, the right-hand side as viewed from the user is the right direction R, the upper side as viewed from the user is the upper direction U, and the down side as viewed from the user is the lower direction D.

Figure 1:
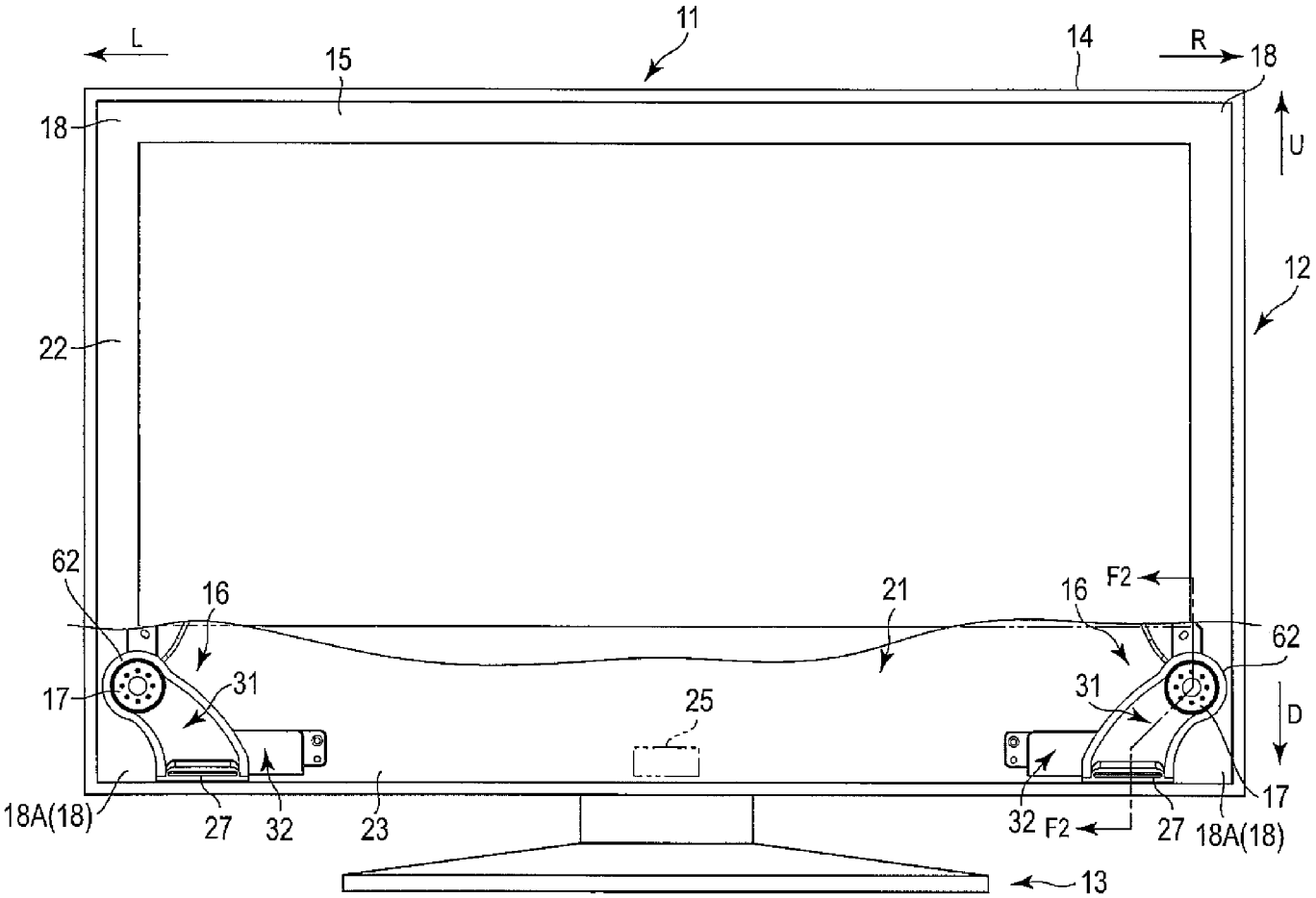
FIG. 1 is an exemplary front view showing a television, which is an example of the electronic device according to the first embodiment.

As shown in FIG. 1, a television 11 of this embodiment is a flat panel display device having a rectangular appearance. As shown in FIG. 1, the television 11 comprises, for example, a main body unit 12 and a stand 13 unit (support portion, base, holder or leg portion) which supports the main body unit 12.

The main body unit 12 comprises a housing 14 formed of, for example, a synthetic resin. Further, the main body unit 12 comprises, inside the housing 14, a display panel 15 (display device, display module or display unit), a pair of speaker boxes (speaker units, sounding units, boxes, support units or housings) 16, a total of two speakers 17 (a pair of speakers) each housed in the respective speaker box 16, a system substrate connected to the display panel 15 to comprehensively control the entire television set, a tuner substrate and a power circuit board. In this embodiment, the display panel 15 comprises, for example, a liquid crystal panel having a rectangular plate shape, but it may be some other type of display panel such as a plasma display panel or an organic EL panel.

The housing 14 comprises a plurality of corner portions (corners, corner sections, end portions, edge portions or peripheral portions) 18, and an enclosed space 21 hermetically (substantially hermetically) sealed provided inside the housing 14 (space defined by closed regions or walls, space in which the ventilation is maintained low, region closed from the exterior of the housing, or region all of whose surfaces are enclosed by the inner walls of the housing and parts, etc.) The pair of speaker boxes 16 are housed inside the enclosed space 21 of the housing 14. As shown in FIG. 2, each of the speakers 17 is placed in the respective speaker box 16 in a direction which crosses the thickness direction T of the housing 14. The plurality of corner portions 18 include a pair of corner portions 18A located in the down direction D, where the pair of speaker boxes 16 are provided, respectively.

The housing 14 comprises a first case 22 (mask, the first housing or the first member) having a frame shape to cover the front surface of the display panel 15, and a second case 23 (cover, the second housing or the second member) to cover the rear surface of the display panel 15. It should be noted here that the first case 22 is a section viewed by the user mainly, whereas the second case 23 is located on an opposite side to the first case 22 and therefore is a section which cannot be easily viewed from the user. The housing 14 comprises the enclosed space 21 in the inside thereof at a position closed to the front direction F. The surroundings of the enclosed space 21 are defined by, for example, the first case 22, the second case 23 and a projecting portion (projection, surrounding portion, surrounding wall, wall, side portion, surface or region) 24 which projects from the second case 23. The projecting portion 24 is an example of the member which defines the surroundings of the enclosed space 21, and it is not limited to the type projecting from the second case 23, but it may be projecting from the first case 22 or may be detachable.

Figure 2:
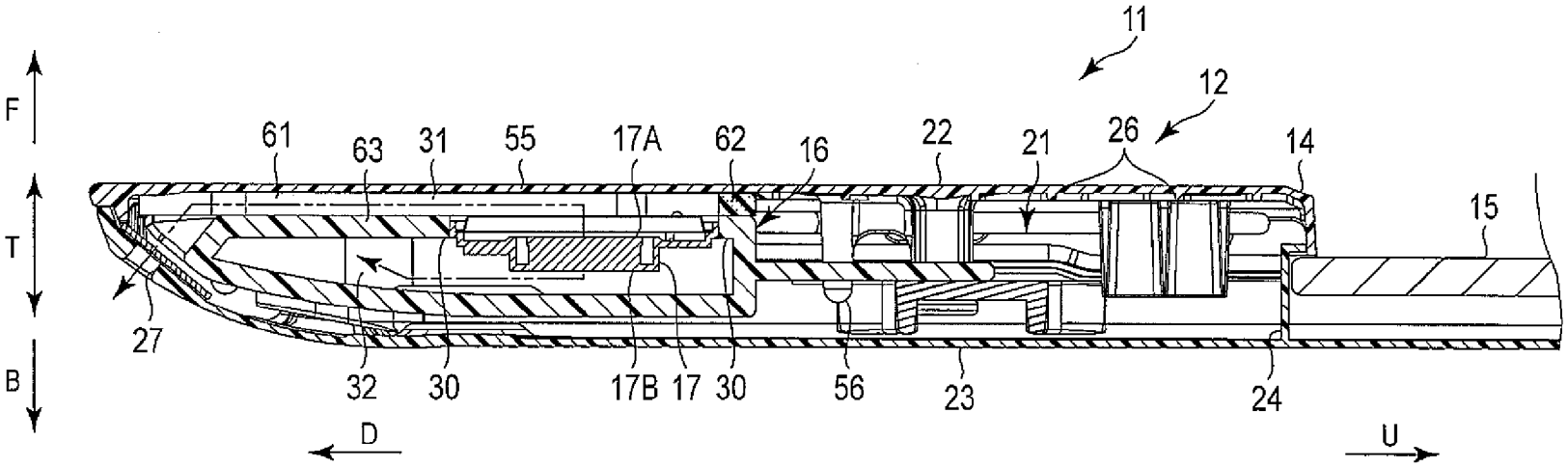
FIG. 2 is an exemplary cross sectional view of the television shown in FIG. 1 taken along the line F2-F2.

As shown in FIGS. 1 and 2, the first case 22 comprises portions 55 each of which faces the respective one of the speaker boxes 16 (portions each of which opposes the respective one of the speaker boxes 16) and a second opening portion (sounding portion, outputting portion, sounding area or outputting area) 25 formed by providing, for example, a plurality of minute through-holes collectively in one area. The second opening portion 25 is located at a position between a pair of first opening portion 27, which will be later described, and is communicated (connected) to the enclosed space 21 (or is set to face thereto). On the inner surface of the first case 22, a plurality of reinforcing ribs (projections, reinforcing members, lattice members, supporting members or supports) 26 are arranged in a honeycomb or a lattice manner for the reinforcement thereof. The structure of the plurality of ribs 26 is similar to that of the second embodiment, and therefore the detailed explanation for the structure will be provided in the description of the second embodiment.

The second case 23 comprises the pair of first opening portion 27 each provided in the vicinity of the respective one of the speaker boxes 16 (that is, in the vicinity of the respective one of the corner portions 18). Each of the first opening portion 27 extends in a direction which crosses the thickness direction T of the housing 14.

Each of the speaker boxes 16 comprises a support unit 30 which supports the speaker 17, a first duct (guiding unit, communicating portion, member surrounding one surface or circumferential surface, or a member extending towards the respective first opening portion 27) 31 which guides sounds from a first face 17A of the speaker 17 to the respective first opening portion 27, and a second duct (guiding unit, communicating portion, member surrounding one surface or circumferential surface, or a member extending towards the enclosed space 21) 32 which guides sounds from a second face 17B, which is on the opposite side to the first face 17A of the speaker 17, towards the enclosed space 21. The structure of each of the speakers 17, the structure of each of the speaker boxes 16, and the peripheral structure of the speaker boxes 16 are similar to those of the second embodiment, and therefore the detailed explanations for the structures will be provided in the description of the second embodiment.

Next, the operation of the speaker box 16 of the present embodiment will now be described. In this embodiment, the sounds output from the first side 17A of the speaker 17 are guided through the first duct 31 and transmitted to the outside of the housing 14 via the first opening portion 27. Here, the sounds guided through the first duct 31 and released from the first opening portion 27 are mainly sounds of high pitches and middle pitches, which relatively have directivity (for example, frequencies of several hundreds Hz or higher). On the other hand, the sounds output from the second side 17B of the speaker 17 are guided through the second duct 32 and released into the enclosed space 21 of the housing 14, and the sounds resonate within the enclosed space 21. Then, the sounds output from the right and left speaker boxes 16 (the second duct 32) are synthesized within the enclosed space 21 and boosted. The sounds guided into the enclosed space 21 are of low pitches, (for example, frequencies of several hundreds Hz or less). The most of the sounds boosted within the enclosed space 21 are propagated to the outside of the housing 14 through the second opening portion 25 provided in the first case 22 (note that the sounds are propagated to the outside through some other holes as well formed in the housing 14).

It should be noted here that in the present embodiment, the sounds of low pitches are propagated to the outside of the housing 14 through the second opening portion 25, but it is alternatively possible to make the enclosed space 21 into a complete (or substantially complete) hermetical state, and propagate sounds to the outside by vibrating the housing 14 itself.

According to the first embodiment, the television 11 comprises the housing 14 further comprising a pair of corner portions 18A and the enclosed space 21, a pair of speaker boxes 16 housed in the enclosed space 21 in the vicinities of the corner portions 18, and a pair of speakers 17 housed in the speaker boxes 16 in the direction which crosses the thickness direction T of the housing 14, and the housing 14 further contains a pair of first opening portion 27 provided in the vicinities of the speaker boxes 16, respectively, and the second opening portion 25 located between the pair of first opening portion 27 and communicated to the enclosed space 21, each of the speaker boxes 16 further comprising the first duct 31 which guides sounds from the first side 17A of the respective speaker 17 to the respective first opening portion 27, and the second duct 32 which guides sounds from the second side 17B, which is on the opposite side to the first side 17A of the respective speaker 17, towards the enclosed space 21.

With this structure, each of the speakers 17 is provided in the direction which crosses the thickness direction T of the housing 14, and thus the diameter of the speakers 17 provided in the housing 14 can be made larger. In order to produce a high-quality sound, it is desirable that the speakers 17 should have a round shape and a proper size. Therefore, with the above-described structure, a high-quality sound can be realized without increasing the thickness dimension of the housing 14.

Further, with the above-described structure, the sounds from the first side 17A of the respective speaker 17 can be released directly to the outside of the housing 14 via the first duct 31. Additionally, the sounds from the second side 17B of the respective speaker 17 are guided via the second duct 32 into the enclosed space 21, in which, mainly, sounds of low pitches can be resonated. The sounds of the low pitches released from the second duct 32 of each of the speaker boxes 16 are synthesized and boosted within the enclosed space 21, and then the sounds are propagated to the outside of the housing 14 through the second opening portion 25. As described above, according to the present embodiment, the sounds are output via two different pathways, and therefore a solid sound can be produced, thereby achieving a high-quality sound.

Apart from the above, the details for each part are similar to those of the second embodiment, and therefore they will be described in the descriptions of the second embodiment, which follow.

Next, the second embodiment of the electronic device will now be described with reference to FIGS. 3 to 13. A portable computer 41, which is an example of the electronic device according to the second embodiment is different in appearance from the television of the first embodiment; however the structure surrounding the main body unit 12 is substantially common to that of the first embodiment. In the following embodiment, the near side (that is, the user side) is defined as the front direction F, the far side as viewed from the user is the rear direction B, the left-hand side as viewed from the user is the left direction L, the right-hand side as viewed from the user is the right direction R, the upper side as viewed from the user is the upper direction U, and the down side as viewed from the user is the lower direction D.

Figure 3:
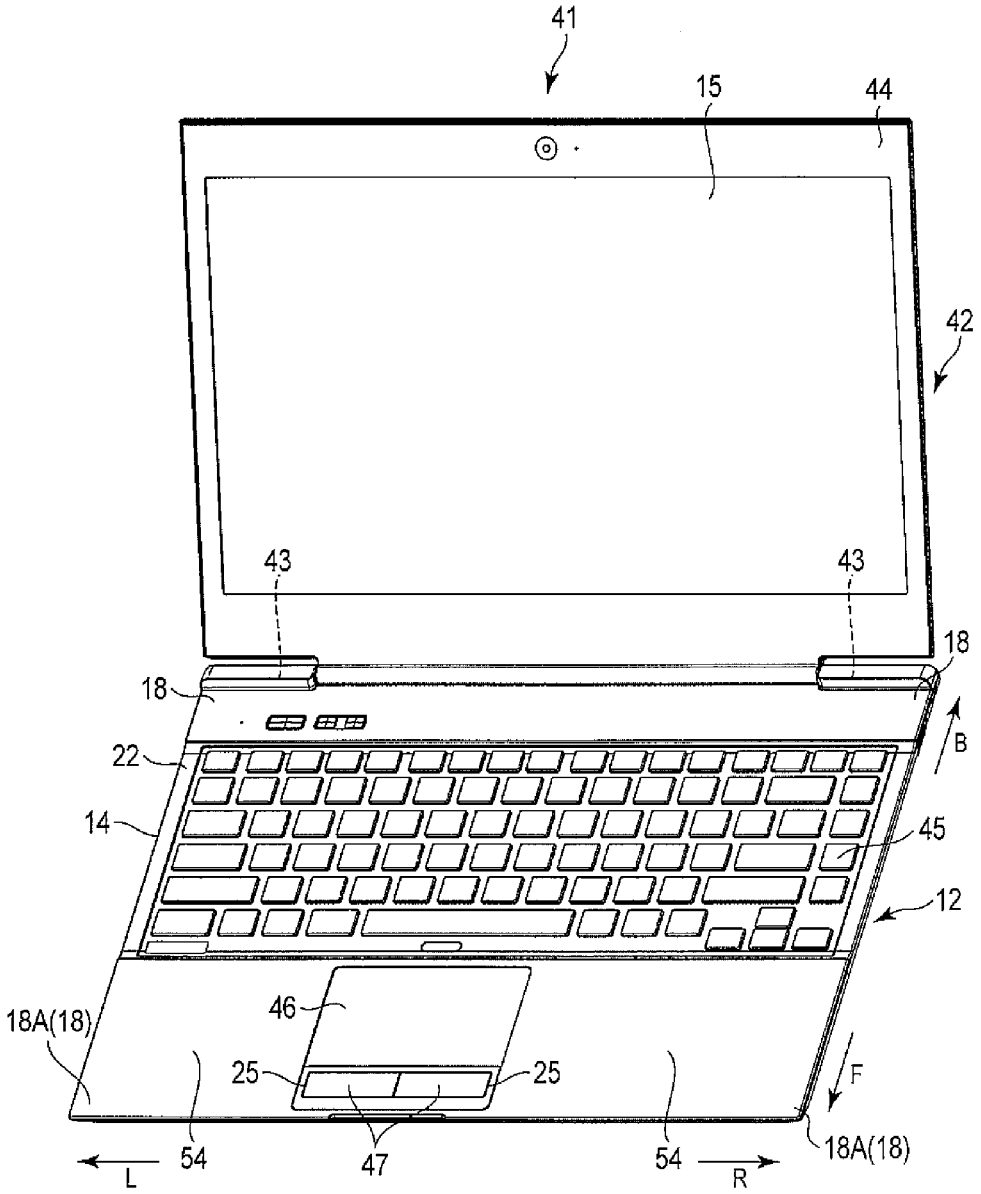
FIG. 3 is an exemplary perspective view showing a portable computer, which is an example of the electronic device according to the second embodiment.

As shown in FIG. 3, the portable computer 41 is the so-called notebook type personal computer. The portable computer 41 comprises a main body unit (first unit or support unit which supports a display unit) 12, a display unit (display or second unit) 42 which can be set to cover the main body unit 12 (in the state where the display is closed to cover the display itself) or to stand upright with respect to the main body unit 12 (in the state where the display is set along a direction intersecting the main body unit to expose the display), and a hinge unit (coupling unit, connection unit or pivoting unit) 43 provided between the main body unit 12 and the display unit 42. The display unit 42 further comprises a display panel 15 (display device, display module, display unit or part) and a display cabinet 44 (housing, cover unit, wall or surface) which covers the surroundings of the display panel 15.

In this embodiment, the display panel 15 comprises, for example, a liquid crystal panel having a square (substantially square or rectangular) plate shape, but it may be some other type of display panel such as a plasma display panel or an organic EL panel.

Figure 4:
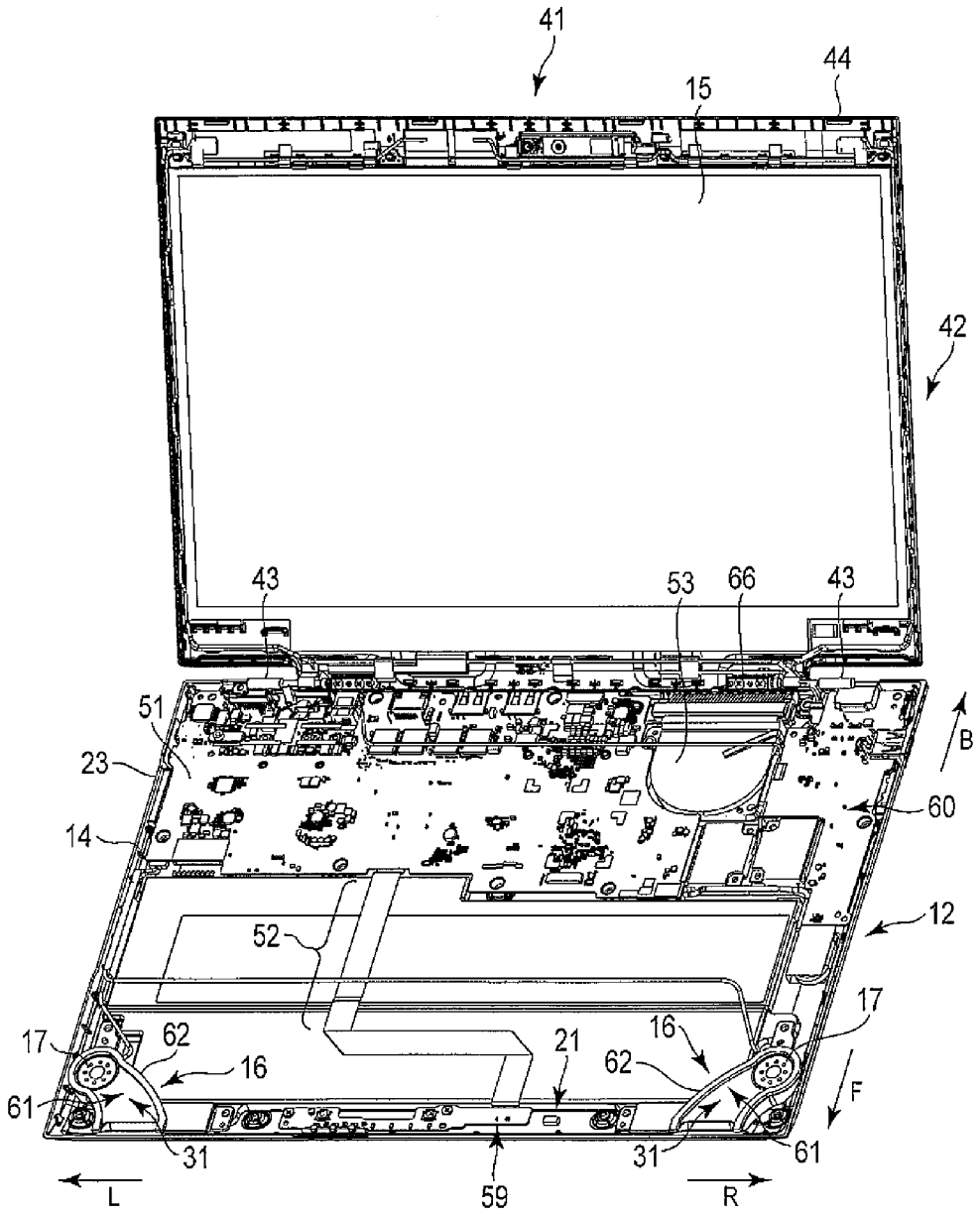
FIG. 4 is an exemplary perspective view showing an inside of the portable computer shown in FIG. 3 while removing a part of the display cabinet and the first case of the housing thereof.

The main body unit 12 comprises a housing (housing structural unit, assembly part or enclosure unit) 14 formed of a metal, for example, a magnesium alloy, a keyboard (data entry unit, entry accepting unit, reception unit, operation unit, operation area, interface unit, data entry module, unit or part) 45 and a touch pad (data entry unit, entry accepting unit, reception unit, operation unit, operation area, interface unit, data entry module, unit, part, face or region where a touch sensor functions) 46, which are attached to the housing 14, and touch pad buttons (data entry unit, entry accepting unit, reception unit, operation unit, operation area, interface unit, data entry module, unit, part or button) 47 provided in the housing 14 in the vicinity of the touch pad 46. As shown in FIG. 4, the main body unit 12 comprises, inside the housing 14, a printed circuit board (substrate, electronic part, part or module) 51, a battery unit (battery, power supply unit, unit, charge unit, part or module) 52, a fan unit (cooling device, fan or heat radiation unit) 53 configured to cool down the parts on the printed circuit board 51, a pair of speaker boxes (boxes, support units or housings) 16, and a total of two speakers 17 (a pair of speakers or output devices) each housed in the respective speaker box 16. The printed circuit board 51 comprehensively controls the entire portable computer 41. The battery unit 52 is provided within the housing 14 at a position close to the front direction F (the position close to the side of the touch pad, touch pad button or palm rest, the position opposite to the display or hinge, the position away from the fan unit, or the position away from the ventilation opening or connector opening portions of the housing). The fan unit 53 is provided within the housing 14 at a position close to the rear direction B (the position opposite to the side of the touch pad, touch pad button or palm rest, the position close to the display or hinge, the position away from the battery unit, or the position within the space where the ventilation opening or connector opening portion is communicating in the housing).

Figure 7:
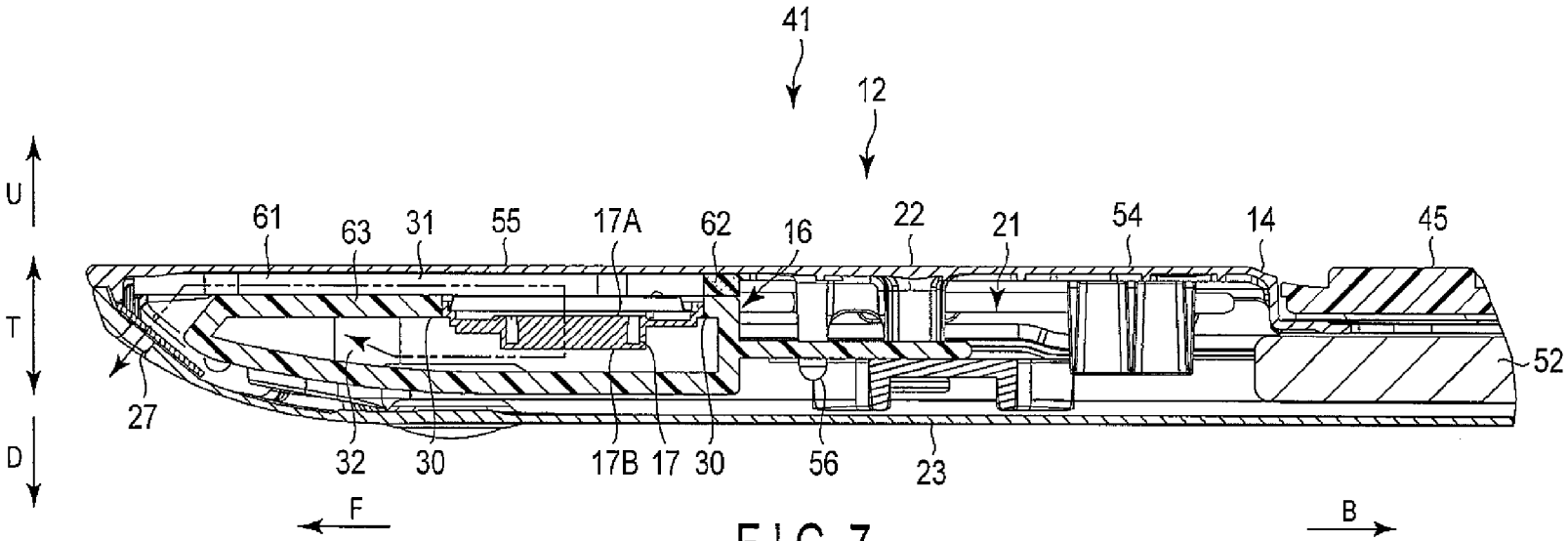
FIG. 7 is an exemplary cross sectional view of the portable computer shown in FIG. 5 taken along the line F7-F7.

As shown in FIG. 7, the housing 14 comprises a plurality of corner portions (corners, corner sections, end portions, edge portions or peripheral portions) 18, a first case (mask, first housing or first member) 22 provided at a position (upper side) to be viewed by the user, and a second case (cover, second housing, second member or bottom) 23 provided at an opposite position (lower side) to the first case 22 and butt-joined with (assembled with) the first case 22. The plurality of corner portions 18 include a pair of corner portions 18A located in the front direction F, where the pair of speaker boxes 16 are provided, respectively.

The housing 14 comprises in its inside the enclosed space 21 at the position close to the front direction F. The enclosed space 21 is provided at a position (front end portion of the housing 14 or end portion or edge portion on the opposite side to the end portion where the hinge is provided) on an inner side of the palm rest portion (wall, face or region on the opposite side to the hinge or display with respect to the keyboard) 54. The surroundings of the enclosed space 21 are defined (enclosed) by, for example, the first case 22 and the second case 23 of the housing 14 and the battery unit 52. The battery unit 52 is an example of the members which define the surroundings of the enclosed space 21, but it suffices if it is a part or structure including a portion, wall, face or area having a shape to cover from the first case 22 over to the second case 23 within the housing 14, or it may be, for example, a standing wall projecting from the inside of the housing 14 or a wall structured by placing a plurality of parts densely. The pair of speaker boxes 16 are housed within the enclosed space 21.

Each of the speakers 17 is placed in the respective speaker box 16 in a direction which crosses the thickness direction T of the housing 14. The speakers 17 have a round shape and a diameter of, for example, about 16 mm to 20 mm in size.

Figure 8:
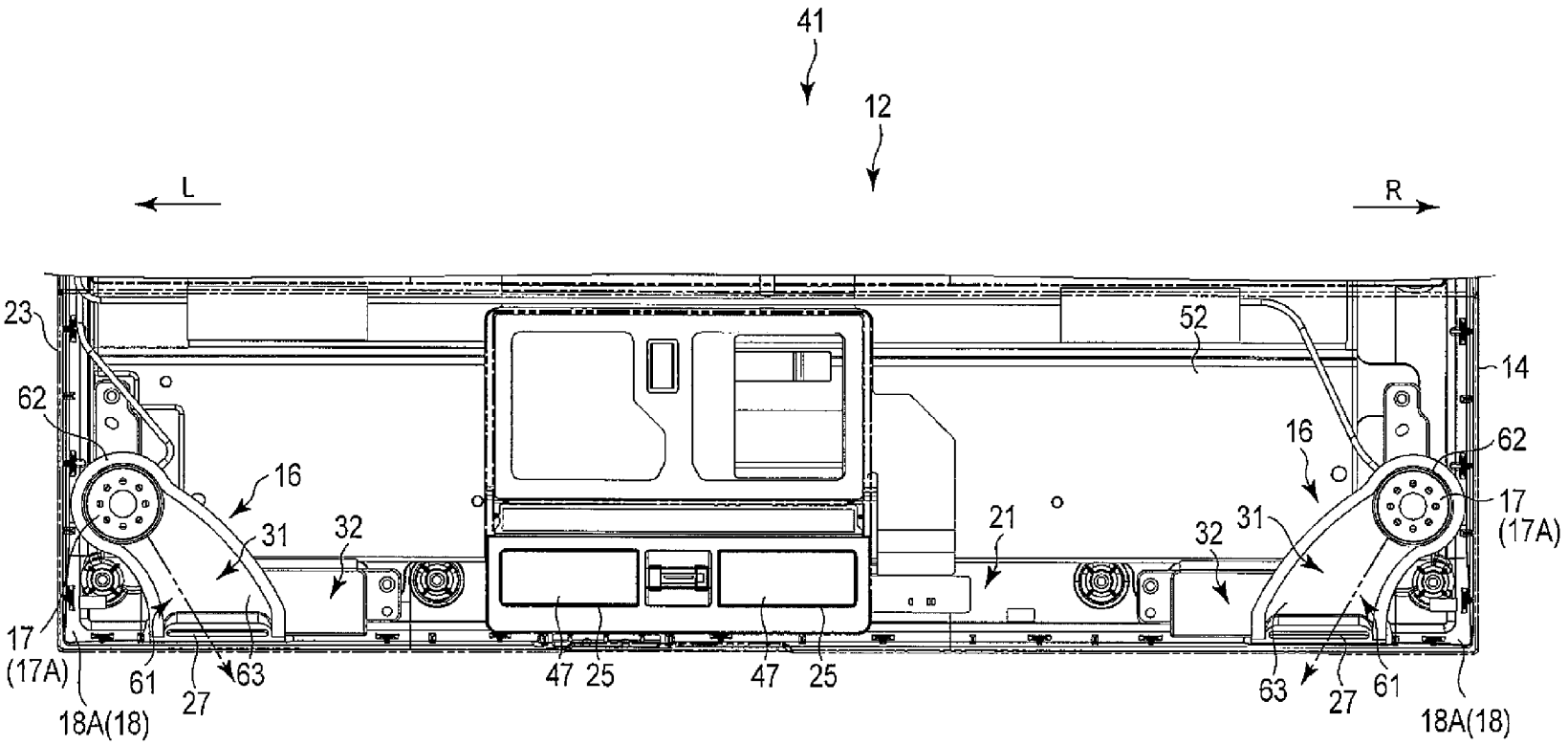
FIG. 8 is an exemplary top view showing an inside of the main body unit of the portable computer shown in FIG. 3 while seeing through the first case of the housing thereof.

The first case 22 comprises the keyboard 45 attached to substantially a central portion thereof (position surrounded by the peripheral portion), and the palm rest portion 54, touch pad 46 and touch pad buttons 47 provided at positions closer to the front direction F than the keyboard 45. The first case 22 comprises the second opening portion 25 communicating to the enclosed space 21 and the touch pad buttons 47 are arranged in an inner side of the second opening portion 25. As shown in FIG. 8, the second opening portion 25 is located at a position between a pair of first opening portion 27, which will be later described.

The first case 22 comprises portions (face, inner surface, wall, region) 55 each of which faces the respective one of the speaker boxes 16 (portions each of which opposes the respective one of the speaker boxes 16) and a plurality of reinforcing ribs (projections, reinforcing portions, lattice portions, supporting portions or supports) 26 projecting towards the inner side (the enclosed space 21). The plurality of reinforcing ribs 26 are arranged in a honeycomb shape (hexagon) and placed mainly at the respective positions corresponding to the palm rest portion 54. It should be noted that the arrangement of the ribs 26 is designed to have a honeycomb shape, but the ribs may be arranged to form some other shape, for example, a lattice, as long as they can form a structure can ensure a rigidity of the housing 14, a rigidity against warping and a deformation inhibition function to a certain degree.

Figure 11:
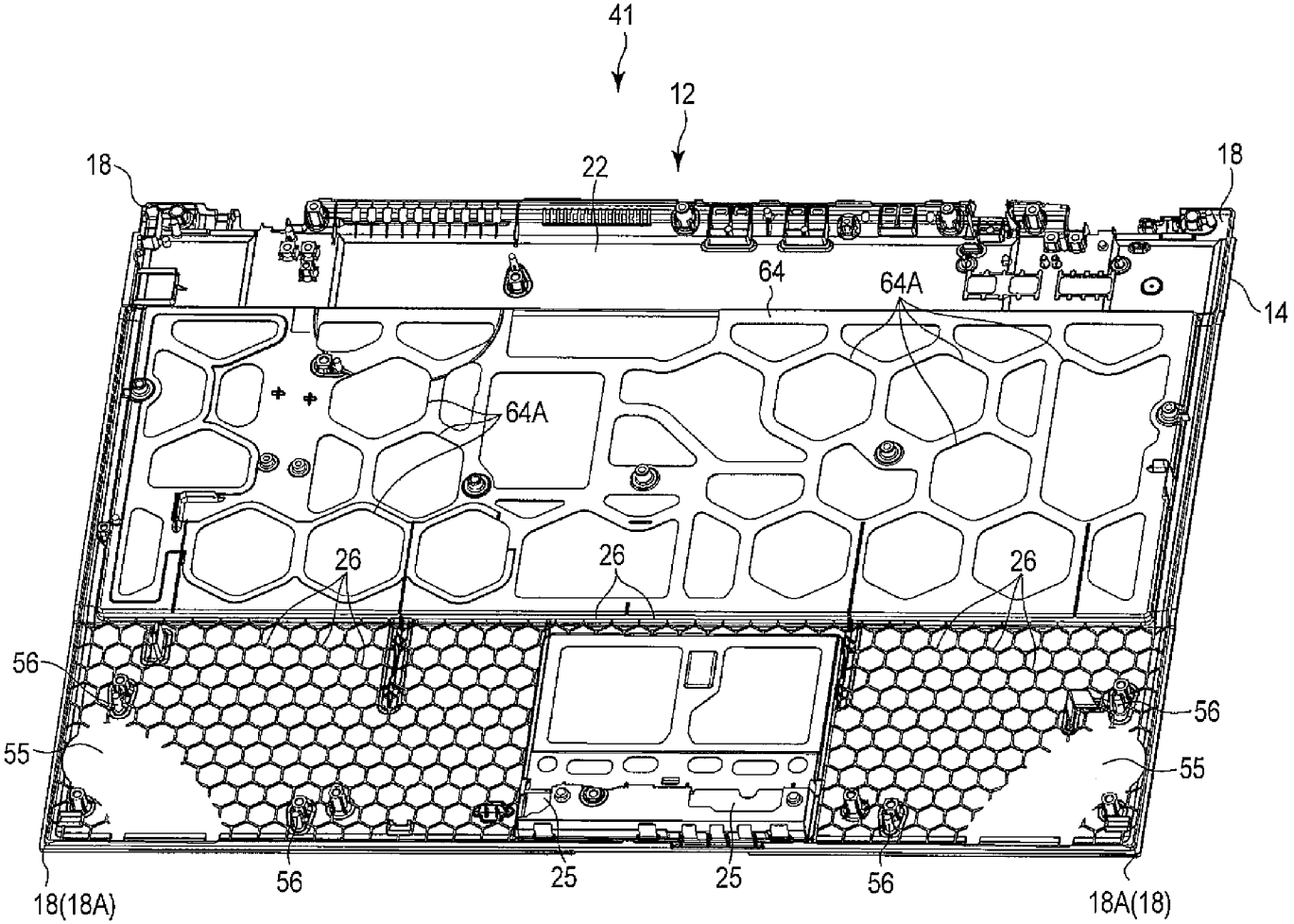
FIG. 11 is an exemplary perspective view showing the first case of the housing in the main body unit of the portable computer shown in FIG. 3 from an inside thereof (a rear side)

As shown in FIG. 11, the plurality of reinforcing ribs 26 are provided at positions off of the portions 55, or they are not provided at the positions which face the speaker boxes 16. In other words, the ribs 26 project to detour the portions 55. Further, the first case 22 comprise a pair of positioning pins (projecting portions, positioning portions, stopper portions or supporting portions) 56 provided therein for positioning each of the speaker boxes 16.

The second case 23 comprises a pair of first opening portion 27 in vicinities of a pair of corner portions 18*a* and also vicinities of the pair of speaker boxes 16. The first opening portion 27 are provided in the second case 23 which cannot be easily viewed from the user, but located in the front direction F on the so-called user side. The first opening portion 27 are provided in a curved portion of the second case 23 close to the front direction F (curved, designed curve) (see FIG. 7). Each of the first opening portion 27 is extended in a direction which crosses the thickness direction T of the housing 14. Further, the second case 23 comprises an air inlet 57 and an air outlet 58 for a fan unit at positions close to the rear direction B of the housing 14 (see FIG. 5).

Figure 12:
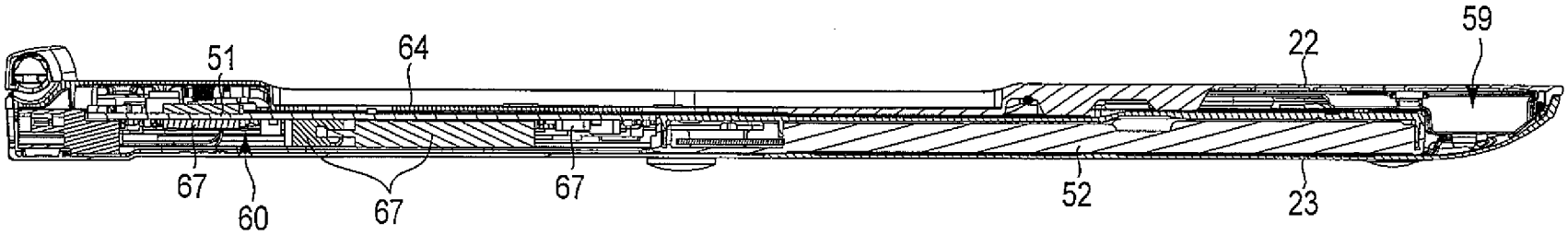
FIG. 12 is an exemplary cross sectional view of the main body unit of the portable computer shown in FIG. 5 while slicing the main body unit in a vertical direction.

As shown in FIG. 12, the battery unit 52 is disposed such that a longitudinal direction thereof is along a longitudinal direction of the housing (that is, along the direction in which the pair of speakers are arranged). Further, the battery unit 52 has a height sufficient to tightly enclose the enclosed space 21 (a height over to the inner surface opposing the housing 14 in its thickness direction, a height the same as or substantially the same as the inner thickness of the housing 14, or a height which can shut off or substantially shut off the ventilation within the housing). With this structure, a first region 59 in which the speaker boxes 16 are provided (a speaker region, a space where sounds are reverberated, a front portion of the housing or a space where the ventilation to the outside of the housing is maintained at low) and a second region 60 (a cooling region, a space where electronic parts are concentrated, or a space where the ventilation from the outside of the housing is set high) in which the fan unit (fan, fan case, motor and fan blade) 53 and cooling fins (a heat radiating portion or heat radiating member) 66 onto which the winds from the fan unit 53 are applied for cool are disposed, are partitioned from each other. With this arrangement, the battery unit 52 exhibits the sound insulation effect and therefore the noise from the fan unit 53 and the like (sound of winds blowing in the housing, wind noise of the fan blades, vibration and operation sounds of the motor, and operation noise of the electronic parts) are not mixed into the sounds of low pitches, which will be described later, of the enclosed space 21 (the first region 59).

Figure 13:
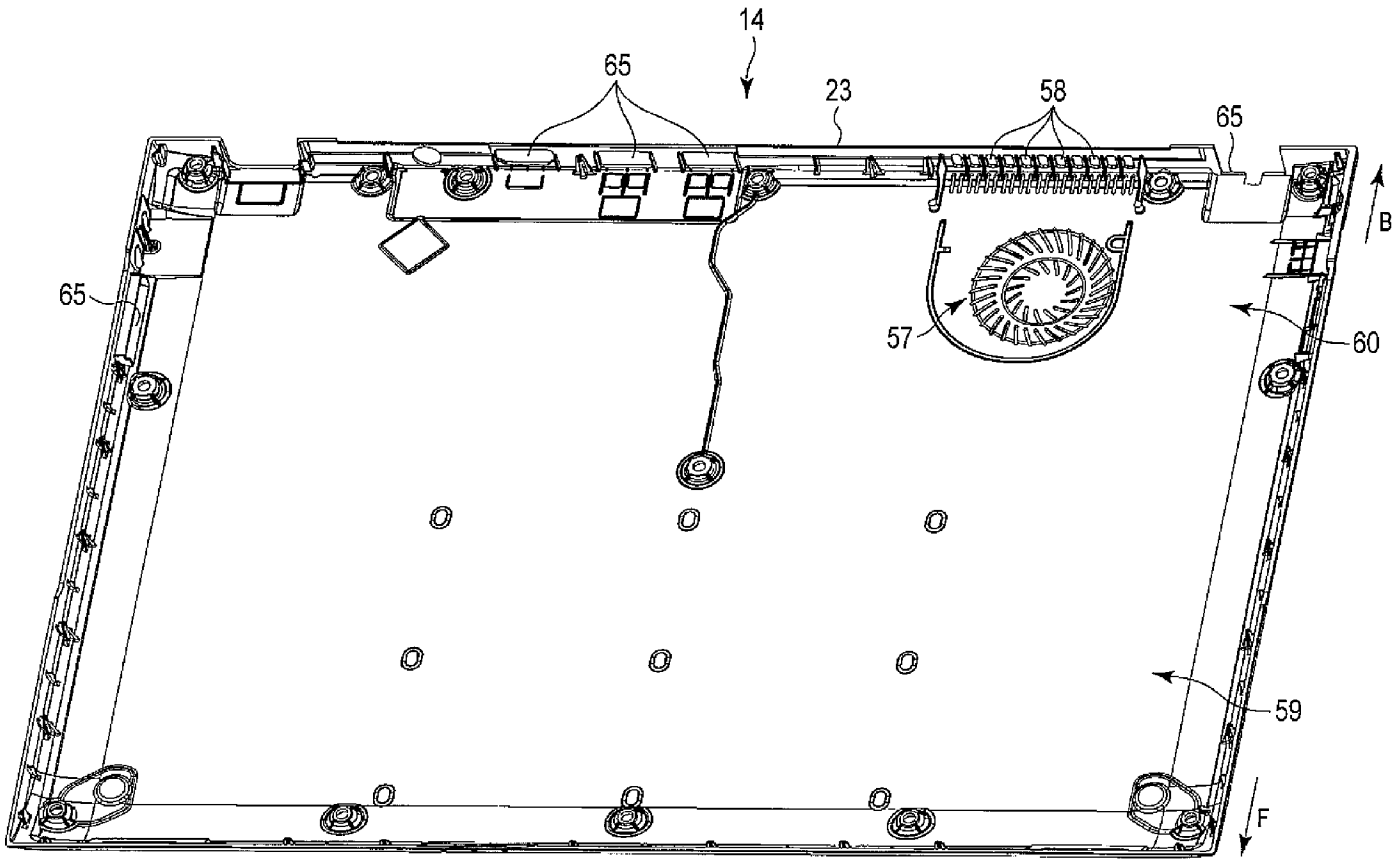
FIG. 13 is an exemplary perspective view showing the second case of the housing in the main body unit of the portable computer shown in FIG. 3 from an inside thereof (a rear side)

As shown in FIGS. 4 and 13, the air inlet 57, the air outlet 58 and the openings 65 for connectors are concentrated in the second region 60 close to the rear direction B of the housing 14 (they are disposed on that side). Further, the first region 59 and the second region 60 are partitioned by the battery unit 52. With this structure, even if an air hole is made in the first region 59, the air in the second region 60 is not allowed to flow into the first region 59 (the air flow is controlled).

As shown in FIGS. 11 and 12, the first case 22 comprises a keyboard support (support portion, support, plate portion, support face or wall) 64 which supports the keyboard 45. The keyboard support 64 comprises a plurality of hexagonal (honeycomb shaped) holes 64A. As shown in FIG. 12, one side of the printed circuit board 51 is tightly attached (substantially attached or brought into contact) to the keyboard support 64 (while interposing an insulator which is not shown in the figure therebetween). With this structure, the leaking of the noise from the fan units 53 and the like from the holes 64A to the outside of the housing 14 can be prevented.

In order to realize such a structure, in this embodiment, the parts (parts having such a shape projecting from the surface such as surface mounting side parts) to be disposed on that one side of the printed circuit board 51 are arranged to match with the inner edge shape of each of the holes 64A while avoiding the surface opposing the portions surrounded by the holes 64 to make a crossbeam-like shape.

As shown in FIG. 12, on the other side, opposite to the one side of the printed circuit board 51, a plurality of parts 67 which have large dimensions in height are collectively provided. With this structure, the one side of the printed circuit board 51 can be placed to be tightly attached to the keyboard support 64, thereby significantly improving the use efficiency of the space within the housing 14.

As shown in FIG. 4 and the like, the longitudinal direction of the printed circuit board (substrate) 51 is set along the longitudinal direction of the housing 14 (the right to left direction). Therefore, in the second region 60 which is partitioned by the battery unit 52, wind flows along the longitudinal direction of the housing 14. Thus, the shape of the printed circuit board (substrate) 51 is formed along the wind flowing direction. In particular, the large-sized parts (parts having a certain packaging height) which have a large heat generation amount are collectively disposed on the other side, on surface of which the winds flow. With this arrangement, the heat of these parts can be radiated in block.

Figure 6:
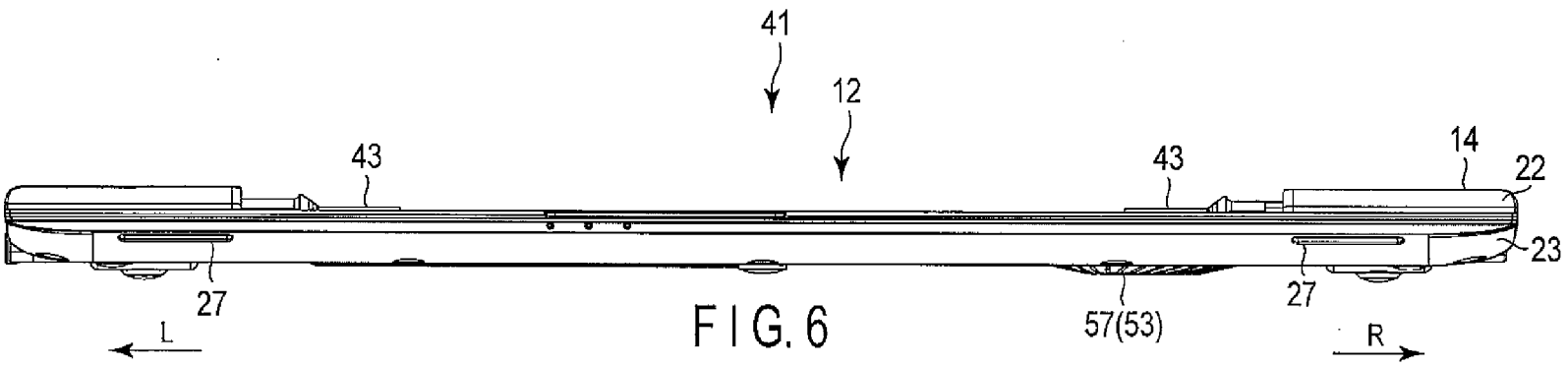
FIG. 6 is an exemplary front view showing the main body unit of the portable computer shown in FIG. 5.

As shown in FIGS. 6, 13 and the like, a part (motor) of the fan unit 53 and a portion of the bottom wall of the housing 14 (the second case 23), which corresponds to the part project downward further from the other part of the bottom wall. Further, a plurality of air holes (opening portions) are provided in the portion projecting downward further from the bottom wall. With this structure, noise and vibrations from the fan unit 53 do not easily propagate to the inside of the housing 14.

Further, rubber legs which support the housing 14 are located directly underneath tall connectors (RGB connector and LAN connector), respectively. With this structure, the housing 14 can be inclined towards the front side. In the posture in which the housing 14 is inclined towards the front side, it can make it further difficult for the sound in the second region 60 to propagate to the user side. (That is, the keyboard and printed circuit board, which serve as sound insulating members located between the second region 60 and user, can be directed towards the user.)

Figure 5:
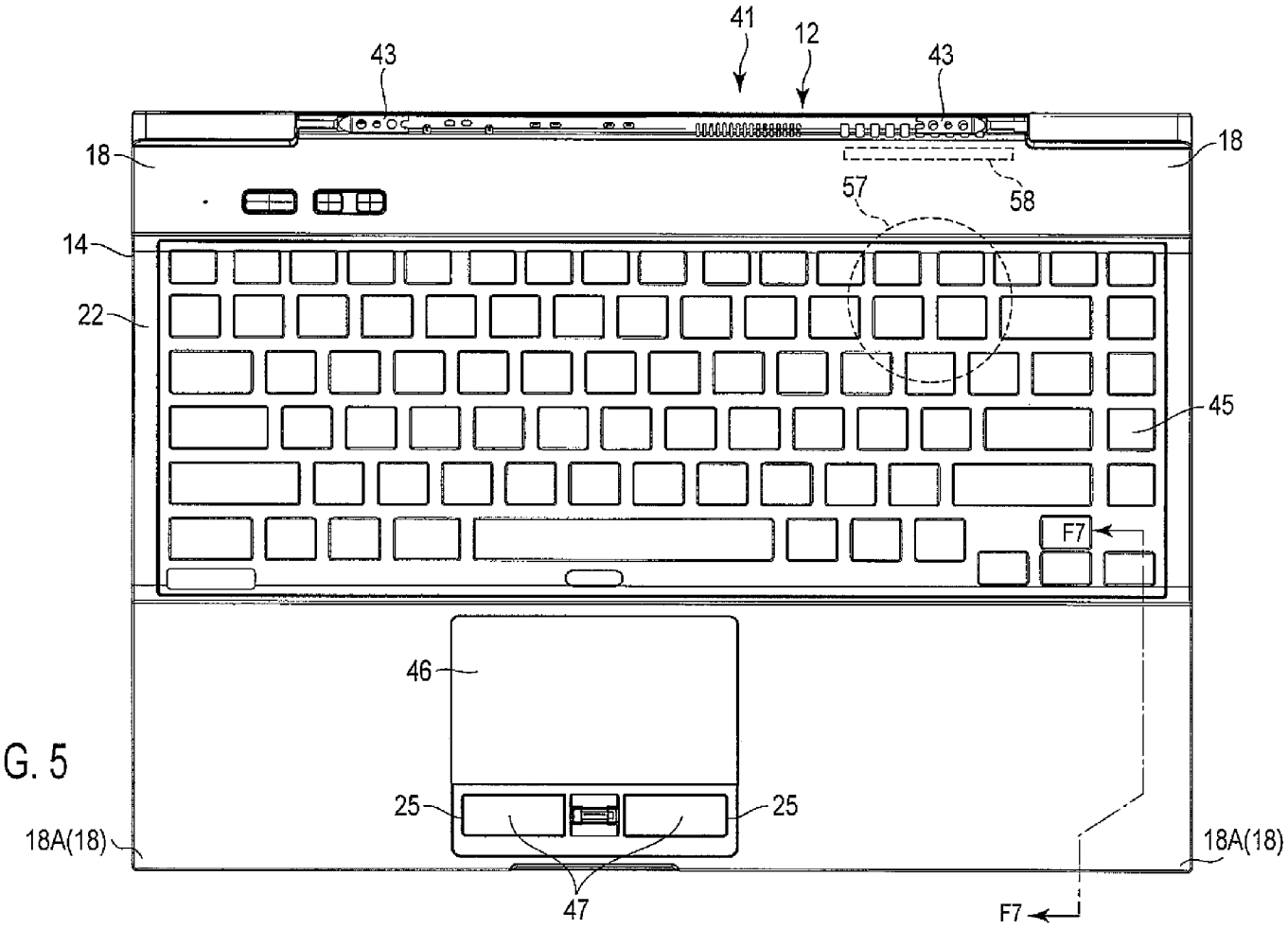
FIG. 5 is an exemplary top view showing a main body unit of the portable computer shown in FIG. 5.

As shown in FIG. 13, the air outlets 58 are provided in the side wall on the rear side B of the housing 14, it releases the winds from the fan unit 53 to the outside of the housing 14 in the rear direction B. The position of the air outlets 58 is set on the opposite side to those where the first opening portion 27 and the second opening portion 25 shown in FIGS. 3 and 5 are provided. With this structure, the air exhaustion sound from the air outlets 58 is output in the opposite direction of the sound from the speakers 17, and therefore the sound effect exhibited by the speaker boxes 16 is not adversely affected by the air exhaustion sound.

Each of the speaker boxes 16 is provided on the front side F of the housing 14. Each of the speaker boxes 16 is formed of, for example, a synthetic resin, such as to contain each respective speaker 17 inside. Each of the speaker boxes 16 is positioned with respect to the first case 22 of the housing 14 via a positioning pin 56, and fixed with, for example, a screw (fixing tool, secure portion, stopper position or fixing portion) or the like. As shown in FIG. 7, each speaker box 16 comprises a support portion 30 which supports the respective speaker 17, a first duct (guide portion, communication portion, member which surrounds one or circumferential surface, a member extending towards the first opening portion 27, member, wall or surrounding portion) 31 which guides the sound from the first side 17A (front side) of the speaker 17 towards the first opening portion 27, and a second duct (guide portion, communication portion, member which surrounds one or circumferential surface, a member extending towards the second opening portion 25, member, wall or surrounding portion) 32 which guides the sound from the second side 17B (rear side) of the speaker 17 towards the enclosed space 21 and the second opening portion 25 communicating thereto.

A wall (a part) of the first duct 31 comprises the portion 55 of the first case 22 of the housing 14, which faces the speaker box 16. With this structure, to be more accurate, each speaker box 16 comprises a groove portion (opening portion, recess portion, projection portion, standing wall portion or wall portion) 61 which constitutes some other wall (other portion) of the first duct 31. The groove portion 61 comprises an elastic member (member having low rigidity, flexible member or deformable or displaceable member) 62 which defines the circumference thereof and a wall portion (face portion) 63 which constitute (serves also as) a part of the second duct 32. The elastic member 62 is adhered to the wall portion 63. The elastic member 62 is formed of, for example, sponge here, but it may be some other type of elastic member such as a rubber. Each speaker box 16 is brought into butt-contact with the portion 55 of the first case 22 via the elastic member 62. The second duct is formed to have a pipe shape.

Figure 9:
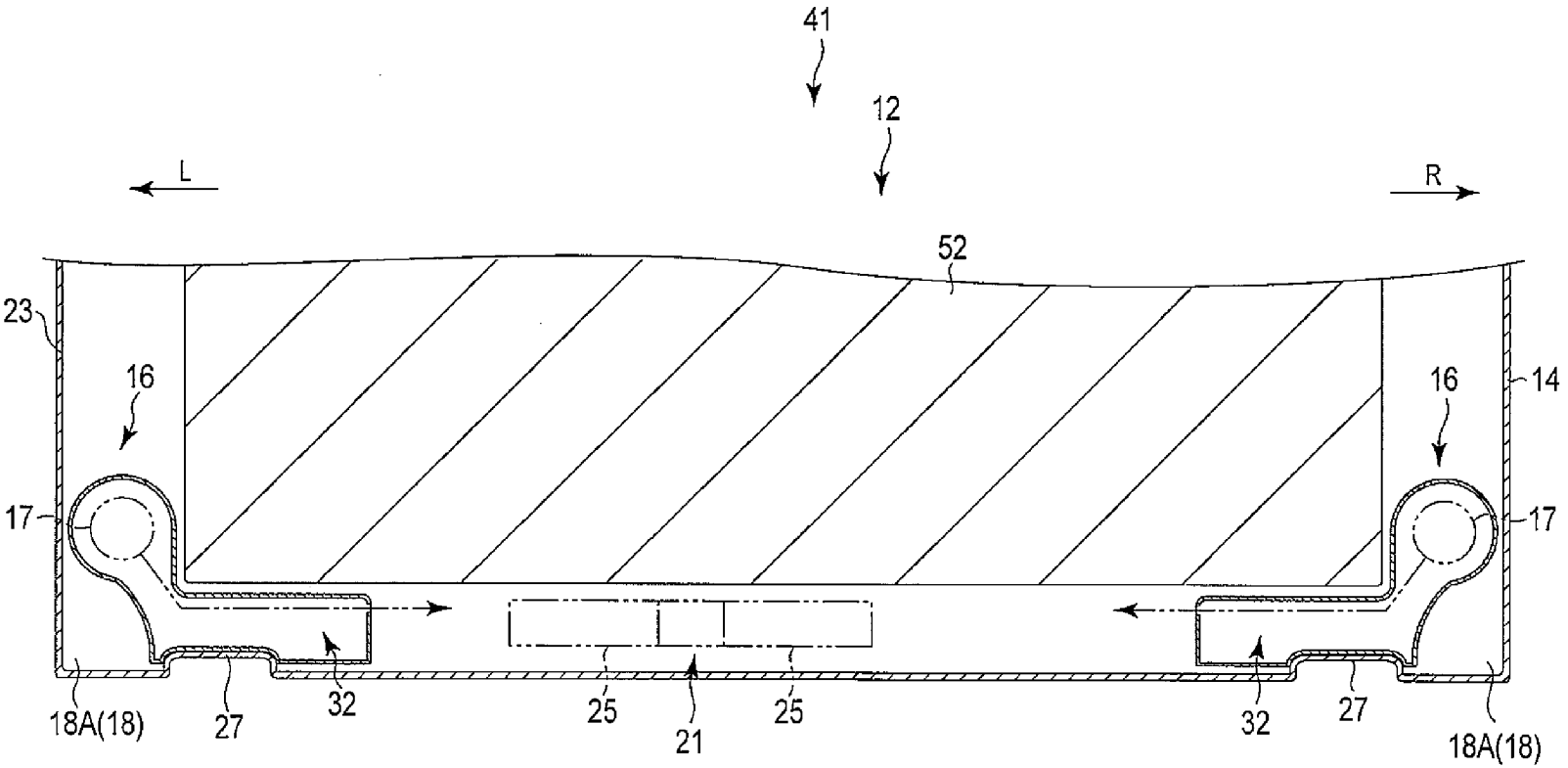
FIG. 9 is an exemplary cross sectional view of the main body unit shown in FIG. 8 while slicing the main body unit in a lateral direction at a height of a second duct of the speaker box.
Figure 10:
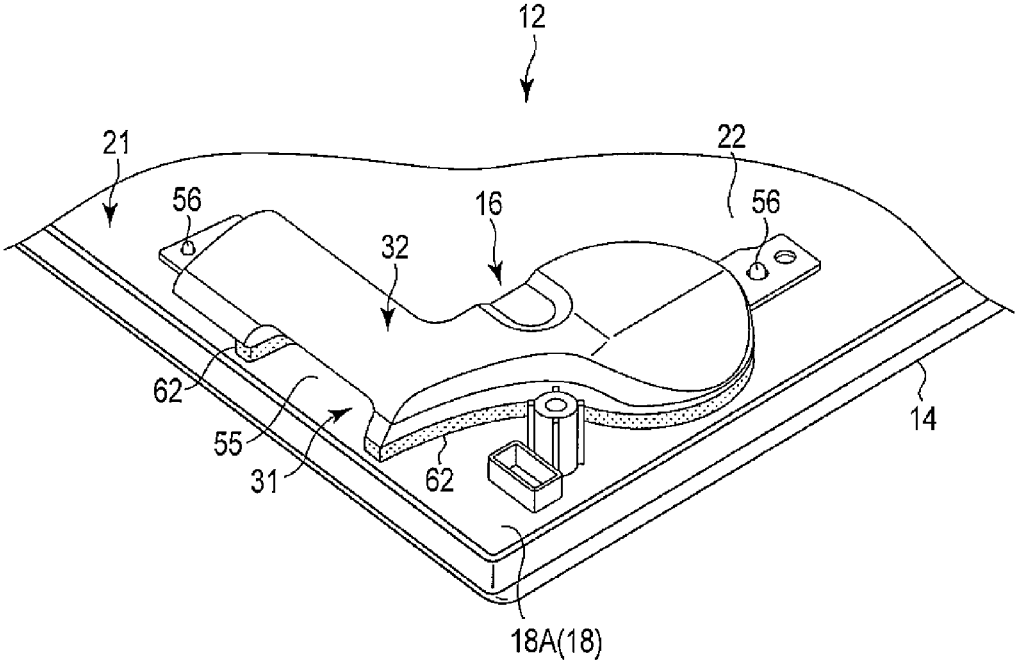
FIG. 10 is an exemplary perspective view showing the first case and the speaker box in the main body unit of the portable computer shown in FIG. 3 while removing the second case of the housing thereof.

Subsequently, with reference to FIGS. 7 to 9, the operation of the speaker boxes 16 of this embodiment will now be described. In this embodiment, each of the speakers 17 generates and releases sounds towards the inner surface (region surrounded by the ribs 26) of the housing 14. That is, the sound releasing side faces the inner surface of the first case 22. Sounds generated from the first side 17A of the respective speaker 17 is guided by the first duct 31 and released to the outside of the housing 14 from the first opening portion 27. Here, the sounds guided through the first duct 31 and released from the first opening portion 27 are mainly sounds of high pitches and middle pitches, which relatively have directivity (for example, frequencies of several hundreds Hz or higher). On the other hand, the sounds output from the second side 17B of the speaker 17 are guided through the second duct 32 and released into the enclosed space 21 of the housing 14, and the sounds resonate within the enclosed space 21. Then, the sounds output from the right and left speaker boxes 16 (the second duct 32) are synthesized within the enclosed space 21 and boosted. The sounds guided into the enclosed space 21 are mainly of low pitches (for example, frequencies of several hundreds Hz or less), which do not have a strong directivity. The most of the sounds boosted within the enclosed space 21 are propagated to the outside of the housing 14 through the second opening portion 25 provided in the first case 22 (note that the sounds are propagated to the outside through some other holes as well formed in the housing 14).

It should be noted here that in the present embodiment, the sounds of low pitches are propagated to the outside of the housing 14 through the second opening portion 25, but it is alternatively possible to make the enclosed space 21 into a complete hermetical state, and propagate sounds to the outside by vibrating the housing 14 itself.

According to the second embodiment, the portable computer 41 comprises the housing 14 further comprising a pair of corner portions 18A, a pair of speaker boxes 16 housed in the housing 14 in the vicinities of the corner portions 18, and a pair of speakers 17 housed in the speaker boxes 16 in the direction which crosses the thickness direction T of the housing 14, and the housing 14 further contains a pair of first opening portions 27 provided in the vicinities of the speaker boxes 16, respectively, and the second opening portion 25 located between the pair of first opening portions 27, each of the speaker boxes 16 further comprising the first duct 31 which guides sounds from the respective speaker 17 to the respective first opening portion 27, and the second duct 32 which guides sounds from the respective speaker 17 towards the second opening portion 25.

With this structure, each of the speakers 17 is provided in the direction which crosses the thickness direction T of the housing 14, and thus the diameter of the speakers 17 provided in the housing 14 can be made larger. In order to produce a high-quality sound, it is desirable that the speakers 17 should have a round shape and a proper size. Therefore, with the above-described structure, a high-quality sound can be realized without increasing the thickness dimension of the housing 14.

Further, with the above-described structure, the sounds from the respective speaker 17 can be released directly to the outside of the housing 14 via the first duct 31. Additionally, the sounds from the respective speaker 17 are guided via the second duct 32 into the enclosed space 21, in which, mainly, sounds of low pitches can be resonated. The sounds of the low pitches released from the second duct of each of the speaker boxes 16 are synthesized and boosted within the enclosed space 21, and then the sounds are propagated to the outside of the housing 14 through the second opening portion 25. As described above, according to the present embodiment, the sounds are output via two different pathways to the outside of the housing 14, and therefore a solid sound can be produced, thereby achieving a high-quality sound.

Further, the housing 14 comprises the portion 55 which faces the speaker box 16, and the portion 55 forms a wall (a part) of the first duct 31. Each speaker box 16 comprises a groove portion 61 which constitutes some other wall of the first duct 31. With this structure, the housing 14 can serve also as one of the wall portions of the first duct 31. With this structure, the thickness of the speaker boxes 16 can be reduced as compared to the case where both of the first duct 31 and the second duct 32 are provided in the respective speaker box 16. Therefore, the housing 14 can be further thinned.

Furthermore, the groove portion 61 comprises the elastic member 62 which defines the circumference thereof and is brought into butt-contact with the portion 55. With this structure, the vibration of each speaker box 16 resulting when generating sounds can be absorbed by the elastic member 62. Thus, the vibration generated by each speaker box 16 is not directly propagated to the housing 14, thereby preventing the creation of chattering in the housing 14. Thus, it is possible to prevent the degradation of the quality of the portable computer 41. (In other words, an upscale image can be given to the portable computer 41.)

The portable computer 41 comprises a member provided within the housing 14 such as to define the surrounding of the enclosed space 21. With this structure, it is possible to prevent the leakage of sound from the enclosed space 21, and thus sounds of low pitches can be boosted (by resonation) in the enclosed space 21, thereby achieving a high quality sound.

Further, the housing 14 comprises the first case 22 provided at a position to be viewed by the user, and the second case 23 provided at an opposite side to the first case 22, and the first opening portion 27 is provided in the second case 23. With this structure, the first opening portions 27 can be hidden such as not to be easily seen from the user's side, thereby making it possible to improve the appearance of the portable computer 41.

The first opening portions 27 each extend in the direction which crosses the thickness direction of the housing 14. In recent years, the profile of the housing 14 of the portable computer 14 has been significantly reduced, and therefore with this structure as well, the first opening portions 27 can be hidden such as not to be easily seen from the user's side, thereby making it possible to further improve the appearance of the portable computer 41.

Furthermore, the housing 14 comprises the ribs 26 projecting towards the enclosed space 21 at positions off of the portions 55. With this structure, it is possible to prevent the ribs 26 from interfering with the transmission of sounds in the first duct 31, thereby achieving a sound effect as designed. Further, the interference between the ribs 26 and the speaker boxes 16 can be prevented, which can contribute to the reduction of the profile of the housing 14.

Moreover, the enclosed space 21 is provided at a position on an inner side of the palm rest portion 54 provided in the housing 14. With this structure, the space enclosed at section on an inner side of the palm rest portion 54 can be effectively utilized as a section where sounds are resonated. In this manner, a high quality sound can be realized without particularly increasing the space. Further, the first opening portions 27 are provided on the user's of the second case 23. With this arrangement, the sounds output from the first opening portions 27 are efficiently propagated to the user, thereby making it possible to realize a high quality sound in this way as well. Further, the first opening portions 27 are never blocked with the hands of the user.

Figure 14:
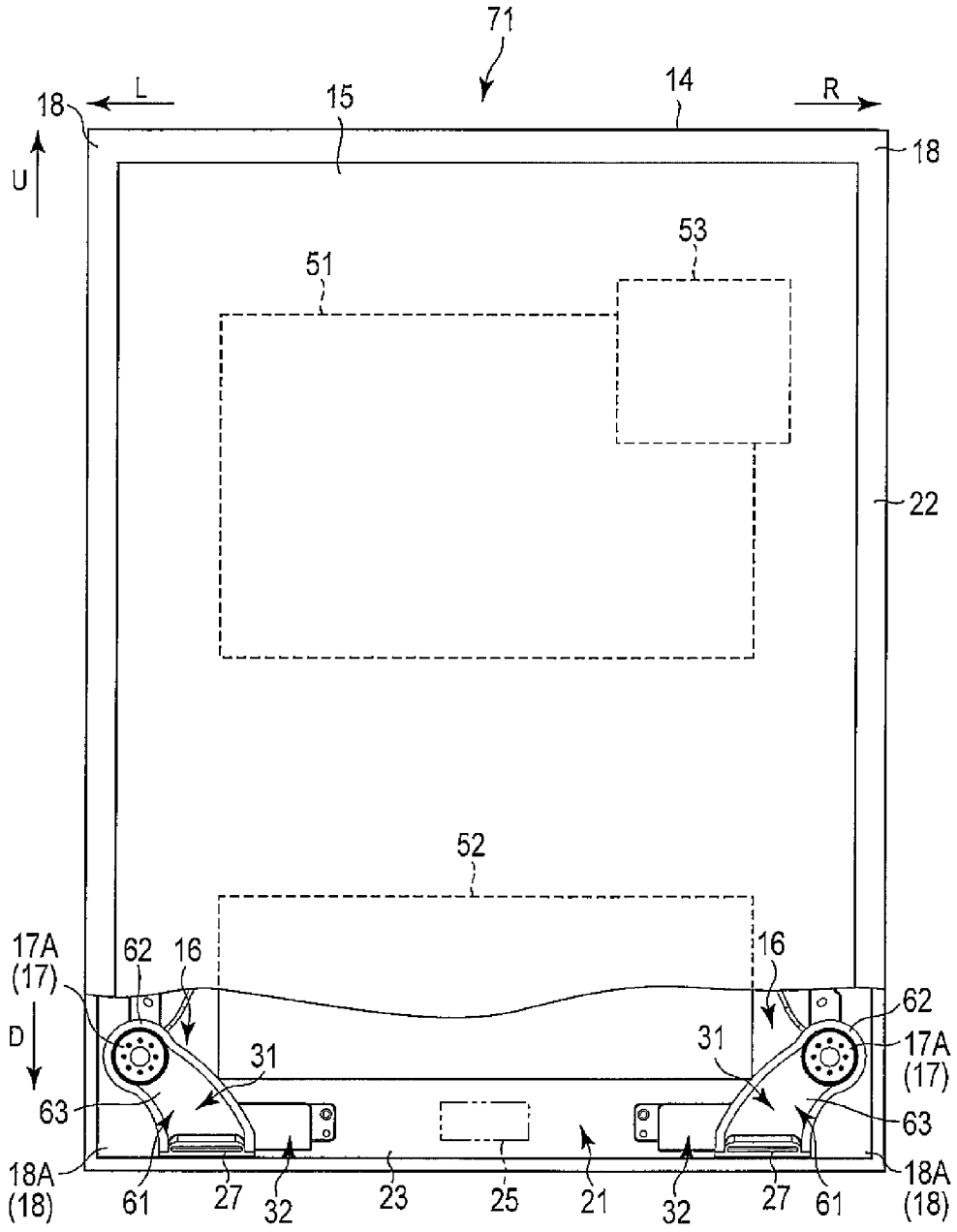
FIG. 14 is an exemplary front view showing a tablet type portable computer, which is an example of the electronic device according to the third embodiment.

Next, the third embodiment of the electronic device will now be described with reference to FIGS. 14 and 15. A tablet-type portable computer 71, which is an example of the electronic device according to the third embodiment is different in appearance from that of the second embodiment; however the rest of the structure is substantially common to that of the second embodiment. Therefore, in the following descriptions, this embodiment will be explained mainly in connection with the different portions from those of the previous embodiment, and common parts will be designated by the same reference numerals and descriptions thereof will be omitted. Further, in the following embodiment, the near side (that is, the user side) is defined as the front direction F, the far side as viewed from the user is the rear direction B, the left-hand side as viewed from the user is the left direction, the right-hand side as viewed from the user is the right direction, the upper side as viewed from the user is the upper direction, and the down side as viewed from the user is the lower direction.

The tablet-type portable computer 71 comprises a housing 14 formed of a metal, for example, a magnesium alloy, and a touch panel type display 15 provided inside the housing 14 such as to expose a part thereof to the outside. As shown in FIG. 14, the tablet-type portable computer 71 comprises, inside the housing 14, a printed circuit board 51, a battery unit 52, a fan unit 53, a pair of speaker boxes 16 and a pair of speakers 17. The printed circuit board 51 comprehensively controls the entire portable computer 71. The user touches the touch panel type display 15 with a finger or the like, to carry out a desired operation onto the tablet-type portable computer 71.

Figure 15:
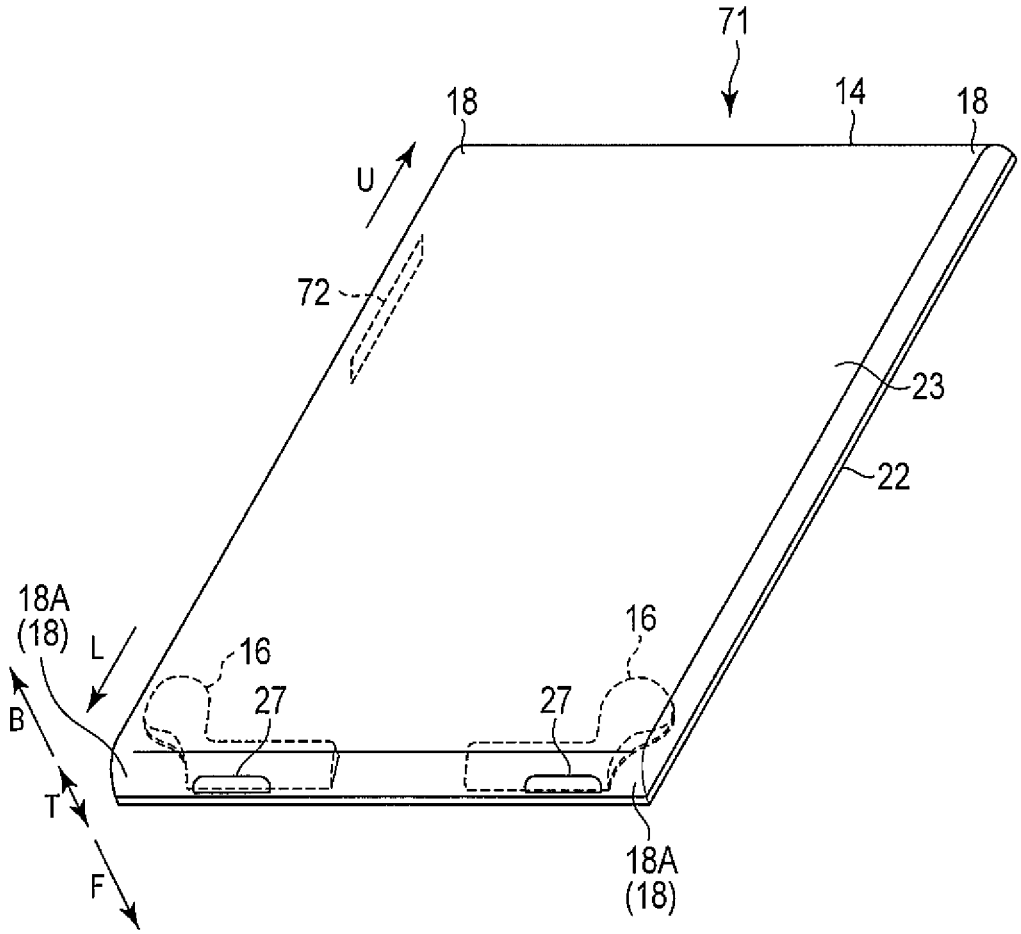
FIG. 15 is an exemplary perspective view of the tablet type portable computer shown in FIG. 14 from a rear direction.

As shown in FIG. 15, the housing 14 comprises a plurality of corner portions 18, a first case 22 provided at a position (upper side) to be viewed by the user, and a second case 23 provided at an opposite position (lower side) to the first case 22 and butt-joined with the first case 22. The plurality of corner portions 18 include a pair of corner portions 18A located in the down direction D, where the pair of speaker boxes 16 are provided, respectively. The housing 14 comprises in its inside the enclosed space 21 at the position close to the down direction D. The surroundings of the enclosed space 21 are defined by, for example, the first case 22 and the second case 23 of the housing 14 and the battery unit 52. The battery unit 52 is an example of the members which define the surroundings of the enclosed space 21. The pair of speaker boxes 16 are housed within the enclosed space 21.

The first case 22 comprises portions 55 each of which faces the respective one of the speaker boxes 16, a second opening portion 25 formed by providing, for example, a plurality of minute through-holes collectively in one area, and a plurality of reinforcing ribs 26 projecting towards the inner side (the enclosed space 21). The second opening portion 25 is located at a position between a pair of first opening portion 27, which will be later described, and is communicated to the enclosed space 21. The plurality of reinforcing ribs 26 are formed on the inner surface of the first case 22 and arranged to form a honeycomb shape (hexagon). Further, as in the second embodiment, this embodiment employs the arrangement that the plurality of ribs, 26 are provided at positions off of the portions 55 and they are not provided in the portions 55 which face respectively the speaker boxes 16.

The second case 23 comprises the pair of first opening portion 27 each provided in the vicinity of the respective one of the pair of corner portions 18A and also in the vicinity of the respective one of speaker boxes 16. The first opening portion 27 are provided in the second case 23 which cannot be easily viewed from the user, but they are located on the down side D, which is on the user's side when used in the hand of the user. The first opening portions 27 each extend in the direction which crosses the thickness direction of the housing 14. Further, the second case 23 comprises air inlet and outlet opening 72 for a fan unit 53 at a position on the upper side U of the housing 14 (see FIG. 15).

Each of the speaker boxes 16 is formed of, for example, a synthetic resin, such as to contain each respective speaker 17 inside. Each speaker box 16 comprises a support portion 30 which supports the respective speaker 17, a first duct 31 which guides the sound from a first side 17A (front side) of the speaker 17 towards the respective first opening portion 27, and a second duct 32 which guides the sound from a second side 17B (rear side) of the speaker 17 towards the enclosed space 21 and the second opening portion 25 communicating thereto.

A part of the first duct 31 comprises the portion 55 of the first case 22 of the housing 14, which faces the speaker box 16. With this structure, to be more accurate, each speaker box 16 comprises a groove portion 61 which constitutes some other portion of the first duct 31. The groove portion 61 comprises an elastic member 62 which defines the circumference thereof and a wall portion 63 which constitute (serves also as) a part of the second duct 32. The elastic member 62 is adhered to the wall portion 63. The elastic member 62 is formed of, for example, sponge here, but it may be some other type of elastic member such as a rubber. The second duct is formed to have a pipe shape.

The operation of the speaker boxes 16 according to this embodiment is similar to that of the second embodiment. It should be noted here that in the present embodiment, the sounds of low pitches are propagated to the outside of the housing 14 through the second opening portion 25, but it is alternatively possible to make the enclosed space 21 into a complete hermetical state, and propagate sounds to the outside by vibrating the housing 14 itself.

According to the third embodiment, the portable computer 71 comprises the housing 14 further comprising a pair of corner portions 18A, a pair of speaker boxes 16 housed in the housing 14 in the vicinities of the corner portions 18, and a pair of speakers 17 housed in the speaker boxes 16 in the direction which crosses the thickness direction T of the housing 14, and the housing 14 further contains a pair of first opening portion 27 provided in the vicinities of the speaker boxes 16, respectively, and the second opening portion 25 located between the pair of first opening portion 27, each of the speaker boxes 16 further comprising the first duct 31 which guides sounds from the respective speaker 17 to the respective first opening portion 27, and the second duct 32 which guides sounds from the respective speakers towards the second opening portion 25.

With this structure, each of the speakers 17 is provided in the direction which crosses the thickness direction T of the housing 14, and thus the diameter of the speakers 17 provided in the housing 14 can be made larger. Further, the sounds from the respective speaker 17 can be released directly to the outside of the housing 14 via the first duct 31. Additionally, the sounds from the respective speaker 17 are guided via the second duct 32 into the enclosed space 21, in which, mainly, sounds of low pitches can be resonated. In this manner, the sounds are output via two different pathways to the outside of the housing 14, and therefore a solid sound can be produced, thereby achieving a high-quality sound.

Note that the electronic device is not limited to the television 11, the portable computer 41 and 71 described in the above-provided embodiments, but it can be naturally carried out in the form of some other type of electronic devices such a mobile phones and electronic book readers which electronically display books, images and the like.

Further, the electronic device is not limited directly to the above-described embodiment, but it can be realized while remodifying the structural elements thereof within the scope where the essence thereof remains. Furthermore, various types of embodiments can be achieved by combining or rearranging various structural elements disclosed in the embodiment appropriately. For example, some of the structural elements may be deleted from the entire structure disclosed in the embodiment. Further, structural elements of various versions may be combined together as needed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A television comprising:

a housing comprising a pair of corner portions, an enclosed space on an inner side of the corner portions, a pair of first opening portions each in a vicinity of a respective one of the pair of corner portions, and a second opening portion between the pair of first opening portions and opening to the enclosed space;

a pair of speaker boxes each in the enclosed space in a vicinity of a respective one of the pair of the corner portions; and a pair of speakers each in a respective one of the pair of speaker boxes in a direction that crosses a thickness direction of the housing, wherein each of the pair of speaker boxes further comprises:

a first conduit configured to transmit sounds from a first side of a respective one of the pair of speakers to a respective one of the first opening portions; and a second conduit configured to transmit sounds from a second side of a respective one of the pair of speakers toward the enclosed space, and wherein the housing further comprises:

housing portions each facing a respective one of the pair of speaker boxes, the housing portions forming a wall of the first conduit; and the pair of speaker boxes each comprising a groove portion that forms another wall of the first conduit.

2. The television of claim 1, wherein the groove portion comprises an elastic member that defines a circumference of the groove portion and is configured to abut the housing portions.

3. The television of claim 2, further comprising an inner member inside the housing, configured to define the enclosed space.

4. The television of claim 3, wherein the housing further comprises a first case, at least some of which is exposed and viewable by a user, and a second case opposite the first case, and the first opening portions are in the second case.

5. The television of claim 4, wherein the first opening portions extend in a direction which crosses the thickness direction of the housing.

6. The television of claim 5, wherein the housing further comprises ribs projecting toward the enclosed space from the housing portions, each of the ribs facing a respective one of the pair of speaker boxes.

7. An electronic device comprising:

a housing comprising a pair of corner portions;

a pair of first opening portions each in a vicinity of a respective one of the pair of corner portions, and a second opening portion between the pair of first opening portions;

a pair of speaker boxes each in the housing in a vicinity of a respective one the pair of corner portions; and a pair of speakers each in a respective one of the pair of speaker boxes in a direction that crosses a thickness direction of the housing, wherein each of the pair of speaker boxes further comprises:

a first conduit configured to transmit sounds from a respective one of the pair of speakers to a respective one of the first opening portions; and a second conduit configured to transmit sounds from a respective one of the pair of speakers towards the second opening portion, and wherein the housing further comprises:

housing portions each facing a respective one of the pair of speaker boxes, the housing portions forming a wall of the first conduit; and the pair of speaker boxes each comprising a groove portion that forms another wall of the first conduit.

8. The electronic device of claim 7, wherein the housing comprises an enclosed space on an inner side of a palm rest in the housing.

9. The electronic device of claim 7, wherein the housing further comprises a first case, at least some of which is exposed and viewable by a user, and a second case opposite the first case, and the first opening portions are made in a user side of the second case.

* * * * *